US007740503B1

(12) United States Patent
Tsai

(10) Patent No.: US 7,740,503 B1
(45) Date of Patent: Jun. 22, 2010

(54) CURRENT NON-INTERRUPTION BULB SOCKET OF LAMP STRING

(76) Inventor: Chang Fu Tsai, 5th Fl., 67-1, Hong-Xiao Rd., Taichung (TW) 407

( * ) Notice: Subject to any disclaimer, the term of this patent is extended or adjusted under 35 U.S.C. 154(b) by 0 days.

(21) Appl. No.: 12/370,360

(22) Filed: Feb. 12, 2009

(51) Int. Cl.
*H01R 33/09* (2006.01)

(52) U.S. Cl. ..... 439/619; 362/226

(58) Field of Classification Search ..... 439/619, 439/611; 362/226, 249, 377, 391, 806; 315/185 R
See application file for complete search history.

(56) References Cited

U.S. PATENT DOCUMENTS 6,053,774 A * 4/2000 Lin ..... 439/619
6,650,065 B1 * 11/2003 Shieh ..... 315/185 R

* cited by examiner

*Primary Examiner*—T C Patel
*Assistant Examiner*—Phuong Nguyen
(74) *Attorney, Agent, or Firm*—Muncy, Geissler, Olds & Lowe, PLLC

(57) ABSTRACT

A lamp string includes first and second wires and a number of lighting units each including a socket receiving a bulb in electrical connection with the wires. The socket includes a husk, which is coupled to the wires and defines a cavity that receives and retains the bulb in such a way to establish electrical connections respectively between first and second contacts of the bulb and the first and second wires, and a plug, which is removably received in the cavity between the bulb and the husk and forms a bore that receives a current bypass device therein. The current bypass device has first and second conductors that are respectively set in electrical connection with the first and second wires. The bore has only an open end to ensure properly installing the current bypass device in the plug.

14 Claims, 7 Drawing Sheets

CURRENT NON-INTERRUPTION BULB SOCKET OF LAMP STRING

BACKGROUND OF THE INVENTION

1. Field of the Invention

The present invention relates to the field of lamp strings, such as a Christmas lamp string, and in particular to a lamp string that comprises a bulb socket that incorporates, in a removable manner, a plug carrying a current bypass device to provide current non-interruption for ensuring proper operation of the lamp string in case of broken bulbs.

2. The Related Arts

A lamp string, such as a Christmas lamp string, comprises a long string of sockets each receiving and holding a bulb, and such a long string of bulbs, when lit, is commonly used as decoration in for example holidays and festivals, especially in the nighttime. Some of the lamp strings use incandescent bulbs and a number of such bulbs are electrically connected in series to form a lamp string or a number of such lamp strings are connected together in parallel. The serial connection of bulbs in a lamp string is disadvantageous in that once one of the bulbs is broken or malfunctioning, the whole string fails, for the bulbs are set in serial connection.

To overcome such a problem, it is often provide a current bypass device, which can be in the form of for example a switching diode or a resistor. When one of the bulbs of a lamp string is broken, electrical current may bypass the broken bulb by flowing through the current bypass device to continuously supply power to the other bulbs of the lamp string, thereby maintaining normal light emission from the other bulbs.

To summarize, the conventional lamp string has the following drawbacks:

(1) For a conventional lamp string that contains no current bypass device, the whole lamp string may fail once one or more of the bulbs that constitute the lamp string are broken; and (2) For a conventional lamp string that is provided with current bypass means, the assembling and repairing are difficult for no specific configuration or structure of the current bypass means is up-to-date known or available and further, it is not feasible for a lamp string manufacturer or general consumers to select if to install the current bypass means in the lamp string, and so is the modification of existing lamp string in this respect.

Thus, it is desired to provide a current bypass device for a lamp string to overcome the above problems.

SUMMARY OF THE INVENTION

Thus, the present invention aims to solve the problems that the conventional lamp string that does not contain current bypass means simply fails when a single bulb thereof is broken or the conventional lamp string that is provided with the current bypass means of which the installation is difficult in that sufficient space is needed and proper installation orientation is often required. The present invention is also made to be applicable to various assemblies of lamp strings.

To solve such problems and drawbacks, the present invention provides a lamp string that comprises first and second wires and a number of lighting units each comprising a socket receiving a bulb in electrical connection with the wires. The socket comprises a husk, which is coupled to the wires and defines a cavity that receives and retains the bulb in such a way to establish electrical connections respectively between first and second contacts of the bulb and the first and second wires, and a plug, which is received in the cavity between the bulb and the husk and forms a bore that receives a current bypass device therein. The current bypass device has first and second conductors that are respectively set in electrical connection with the first and second wires. The bore has only an open end to ensure installing the current bypass device in the plug at a desired orientation. The current bypass device allows electrical current to bypass a broken bulb so that the electrical current can continuously flow to the other bulbs of the lamp string to maintain proper operation of the lamp string. The plug is received in the husk in a removable manner and this allows the socket to serve as a regular socket to receive and hold a bulb therein, forming a regular lighting unit without the current bypass device. The plug can be manufactured separately and easily installed in the socket. The assembling is made easy and the manufacture of a lamp string is simplified.

The effectiveness of the present invention is that, compared to the conventional lamp string that fails when one of the bulbs is broken or that needs to be elaborately designed in order to accommodate current bypass means, the bulb socket of the present invention is configured to receive a plug that carries a current bypass device therein in a removable manner so that the plug can be selectively removed to convert the socket into a regular socket for receiving a bulb without the current bypass device and the current bypass device functions to allow electrical current to flow therethrough when the bulb is broken so as to maintain the proper operation of the remaining bulbs of the lamp string. The plug can be manufactured separately and easily installed in the socket. The assembling is made easy and the manufacture of a lamp string is simplified.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

Figure 1:
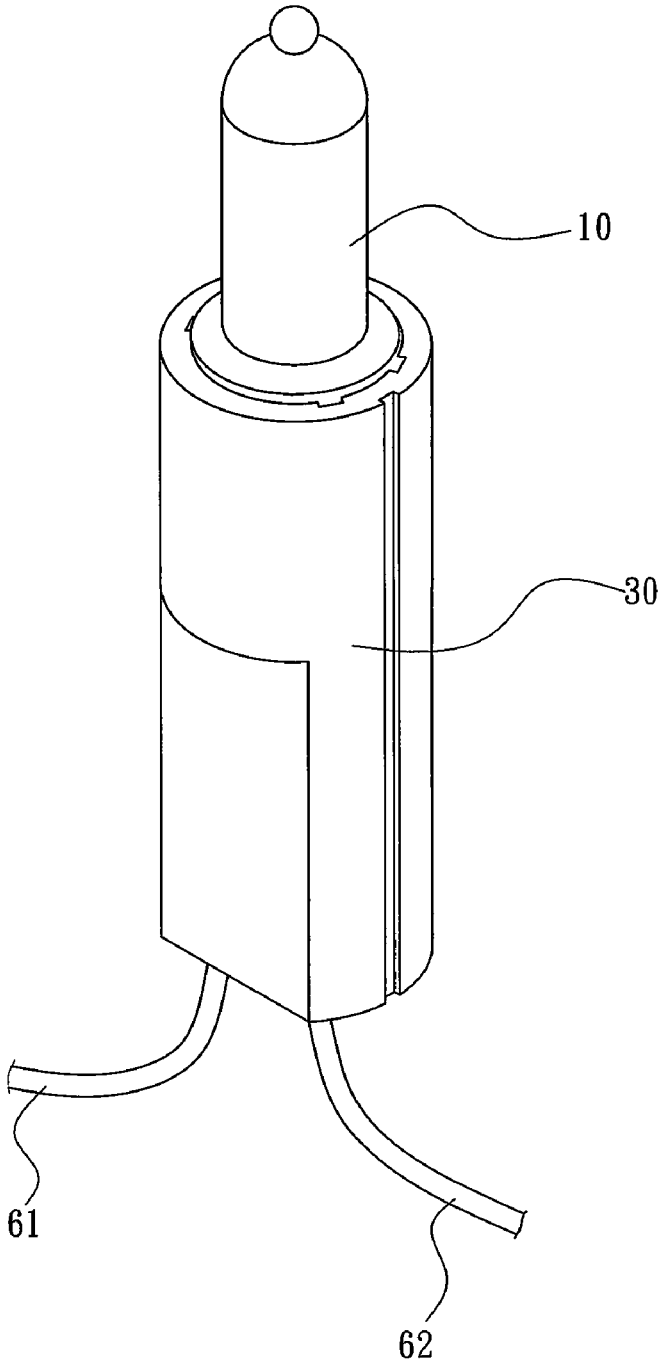
FIG. 1 is a perspective view of a bulb socket constructed in accordance with the present invention for serial connection with electrical wires to make a lamp string.
Figures 2, 2A:
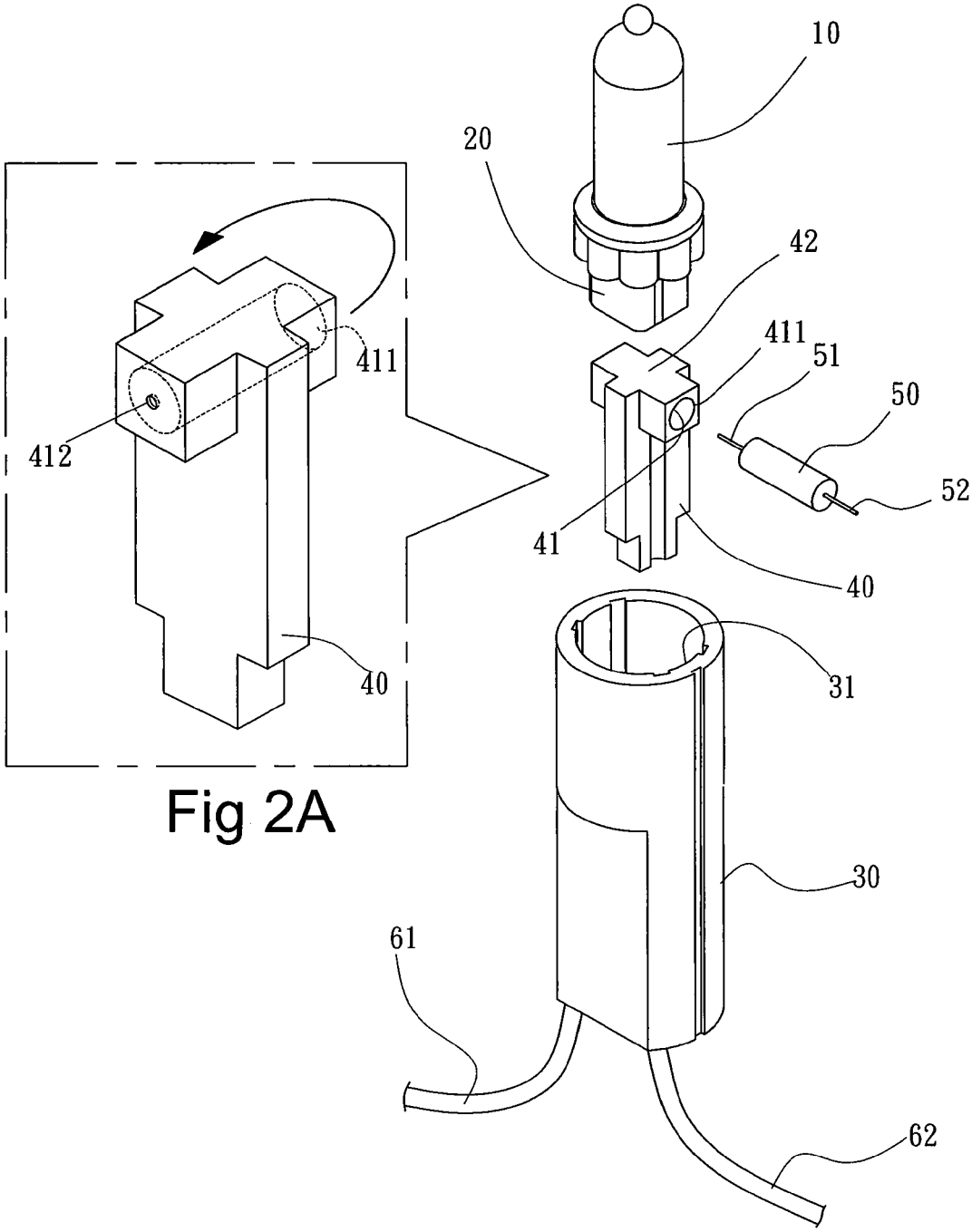
FIG. 2 is an exploded view of the bulb socket of the present invention.
FIG. 2A is an enlarged perspective view of a plug that is received in the bulb socket in accordance with the present invention.
Figure 3:
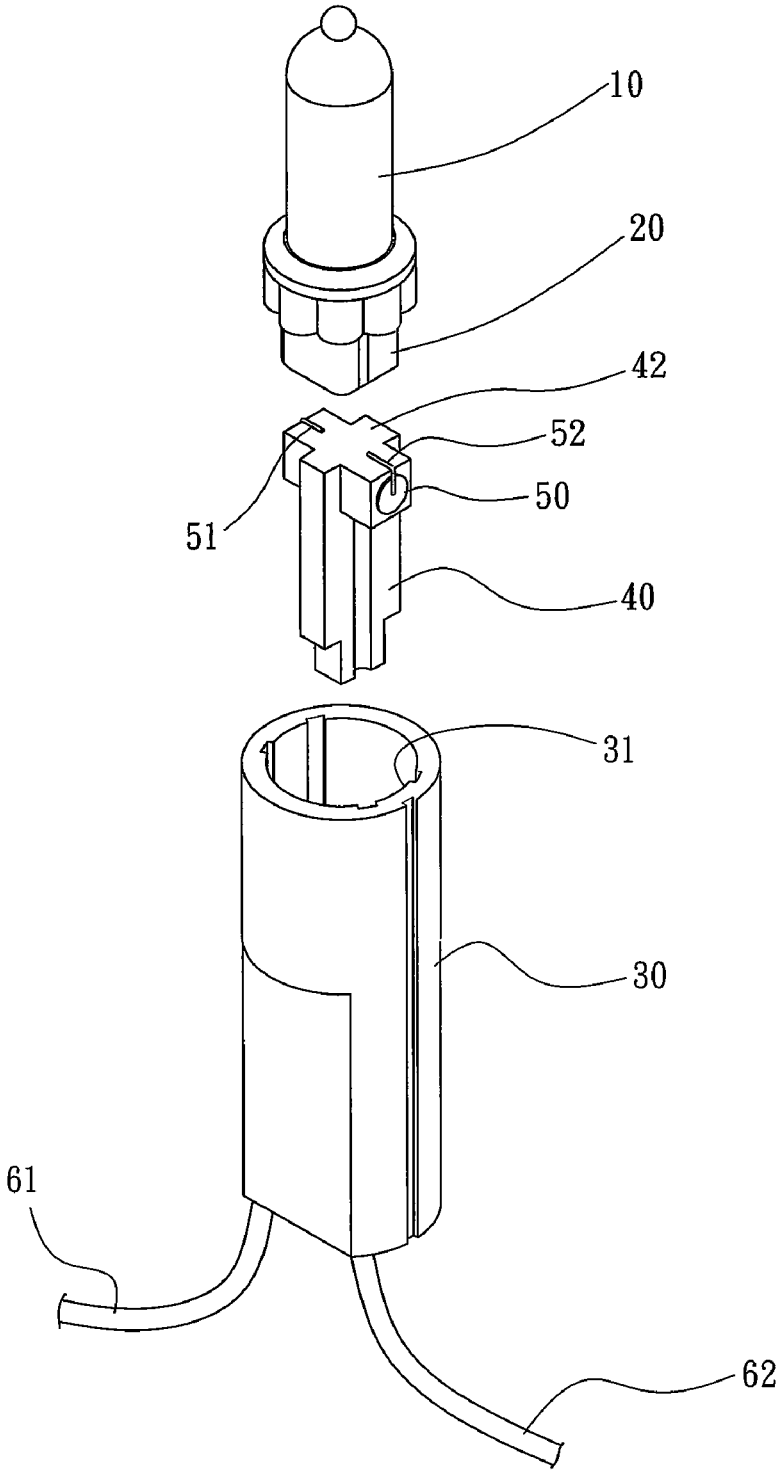
FIG. 3 is another exploded view of the bulb socket of the present invention, with a current bypass device received in a bore defined in the plug.

The present invention provides a current non-interruption bulb socket for a lamp string. A more detailed explanation of an example embodiment of the current non-interruption bulb socket in accordance with the present invention will be given below, reference being had to the attached drawings.

Reference is first made to FIGS. 1, 2, 2A, and 3, which show the example embodiment of the present invention. To maintain proper operation of a lamp string without being affected by malfunctioning of individual bulbs constituting the lamp string, the present invention provides a current bypass device in each bulb socket of the lamp string. Thus, the installation of the current bypass in the bulb socket must be carefully elaborated and will be further described.

In the example embodiment, a lamp string comprises a number of bulb sockets connected in serial by electrical wires 61, 62. Each bulb socket is constructed to provide electrical and mechanical engagement with a lamp bulb 10, whereby the lamp bulb 10 is securely held in the socket and electrical connection is established between the lamp bulb 10 and the electrical wires 61, 62. The bulb 10 comprises a bulb holder 20 for fitting into the socket. The socket comprises a husk 30 that is a hollow member made of insulation material, defining a cavity 31 having an open end for receiving the bulb holder 20 to establish mechanical engagement therebetween. The bulb holder 20 is preferably made to closely fit into the open end of the cavity 31 to be retained in the cavity 31. Apparently, other known means can be adopted, alternatively or additionally, to retain the bulb 10 in the husk 30.

An internal plug 40, made of insulation material, is received in the husk 30 and set between the bulb holder 20 and the husk 30. The plug 40 is of such a size and configuration as to be closely received in the cavity 31 that is defined in the husk 30 and has a top opening. Preferably, the plug 40 is provided with a fool-proof configuration to ensure proper installation thereof. The plug 40 forms a transverse bore 41 that has a single open end 411. A current bypass device 50 is received, through the open end 411, into the bore 41. The single open end 411 of the bore 41 ensures that the current bypass device 50 can only be received in the bore 41 in a correct orientation and allow to identify proper positioning of the current bypass device 50 when the current bypass device 50, of which installation orientation might matter, is being received in the bore 41. An opposite end of the bore 41 is closed and the closed end forms an aperture 412 through which a first wire conductor 51 (such as a copper wire) of the current bypass device 50 extends outside the plug 40. The portion of the first conductor 51 that extends out of the plug 40 is bent to overlap a flat top face 42 of the plug 40 that opposes the bulb holder 20. The current bypass device 50 also has a second wire conductor 52 (such as a copper wire) that is at least partially exposed outside the plug 40 through the open end 411 and is also bent to overlap the top face 42 of the plug 40. The conductors 51, 52 are sized so that they are not in contact with each other when they are put on the top face 42 of the plug 40, to ensure no shorting therebetween.

The current bypass device 50 functions to allow flow of electrical current therethrough when the bulb 10 is inoperative so as to maintain proper operation of the lamp string. The plug 40 is elaborately designed so as to be removable from the husk 30 of the socket and, in this way, the socket may still receive and work with a bulb, which can be of the same or different configuration as the bulb 10. This makes the socket of the present invention operable as a regular socket that simply receives a bulb therein or as a current non-interruption socket by receiving the plug 40 that carries the current bypass device 50 and a bulb 10 therein. The plug 40 can be manufactured separately and easily installed in the socket. The assembling is made easy and the manufacture of a lamp string is simplified.

Figure 4:
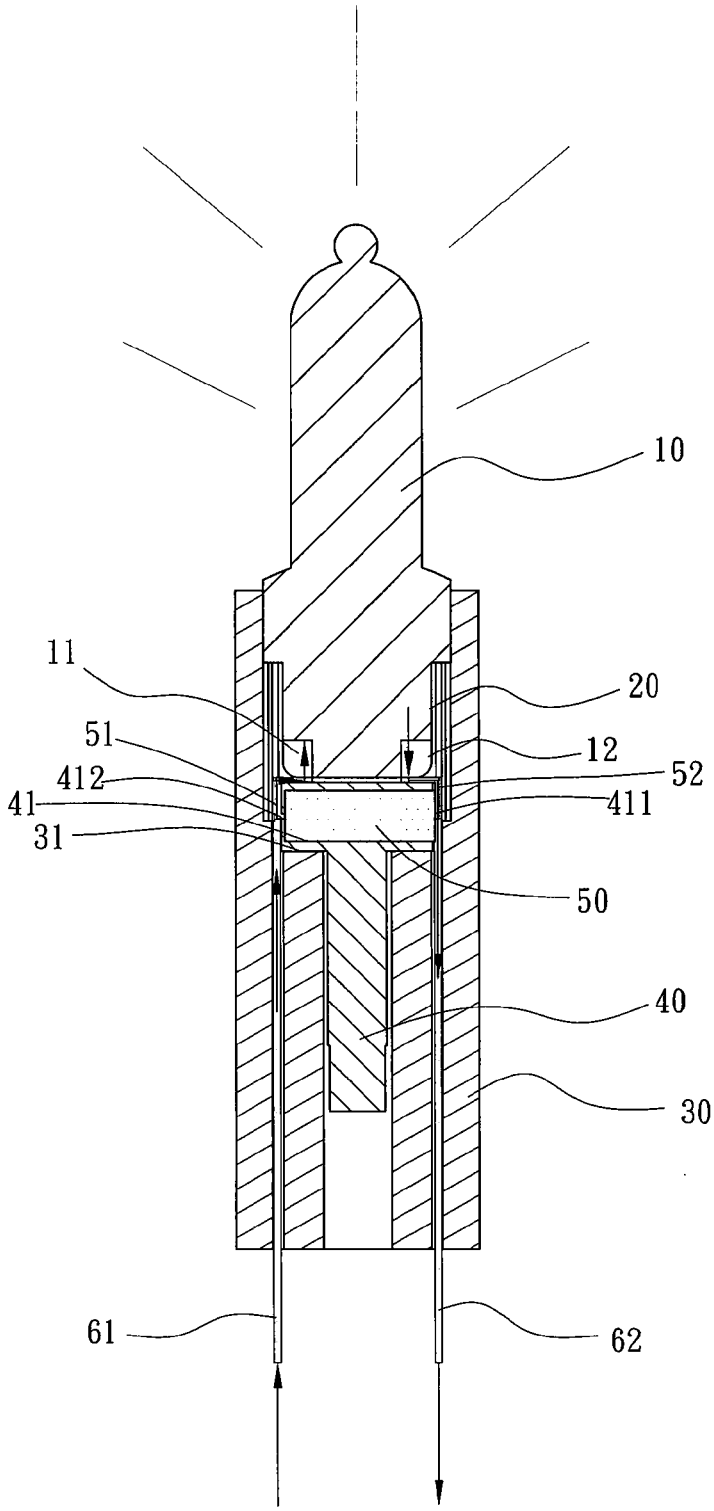
FIG. 4 is a cross-sectional view of the bulb socket of the present invention, illustrating a current flow through the bulb socket and a bulb received therein to emit light.

Referring to FIG. 4, for consideration of in respect of size reduction, manufacturing easiness, and cost lowering, the present invention provides a plug 40 that is receivable in a top-open cavity 31 defined in a husk 30 of a bulb socket and the plug 40 forms a transverse bore 41 that has a single open end 411 to allow receipt of a current bypass device 50 therein from a fixed side. With such a configuration, after a bulb holder 20 of a bulb 10 is fit into the opening of the cavity 31 of the husk 30, the bulb 10, the plug 40, the current bypass device 50, and the husk 30 of the socket are assembled together as a modularized lighting unit, which facilitates the assembling/manufacturing a lamp string.

The wire 61 that extends into the husk 30 of the socket is in contact with the first conductor 51 of the current bypass device 50 so as to establish electrical engagement with the first conductor 51 and thus electrically connected to a first contact 11 of the bulb 10. The bulb 10 has a second contact 12 that is in electrical connection with the second conductor 52 of the current bypass device 50 that is set in contact with the second wire 62 so that electrical connection is set up between the second contact 12 of the bulb 10 and the second wire 62 and the second conductor 52 of the current bypass device 50. When an electrical current is applied through the first wire 61, the current flows sequentially through the first wire 61, the bulb 10 and/or the current bypass device 50, and the second wire 62 to a next bulb of the lamp string.

Figure 6:
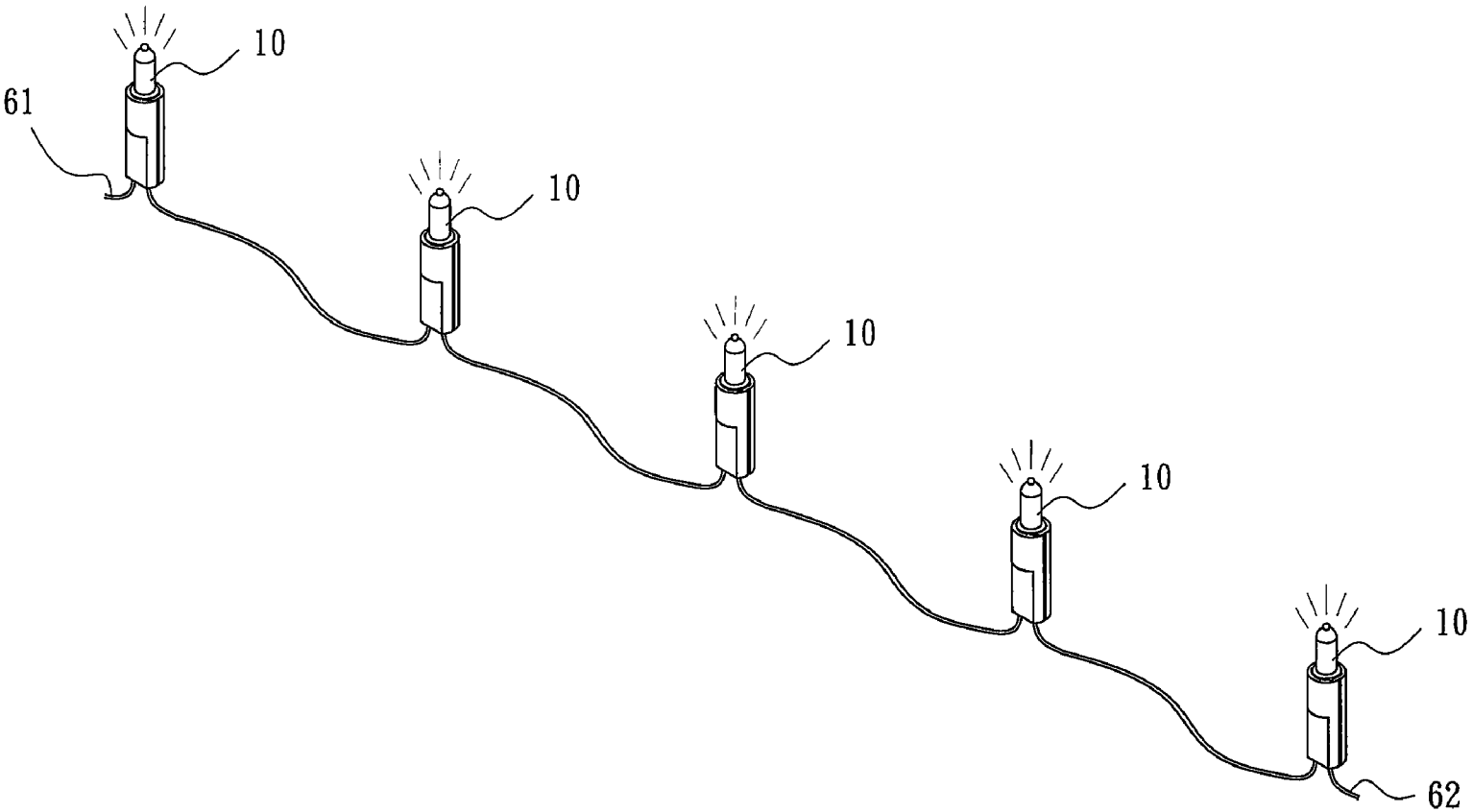
FIG. 6 is a perspective view illustrating a lamp string of which all the bulbs operate normally to give off light.

Referring to FIGS. 4 and 6, when the bulb 10 is in normal operation, the current supplied from the first wire 61 flows to the first contact 11 of the bulb 10, through the bulb 10 and reaching the second contact 12, and then flows into the second wire 62 for being further supplied to the next bulb of the lamp string. With the current flowing through the bulb 10, the bulb 10 is lit and gives light emission.

Figure 5:
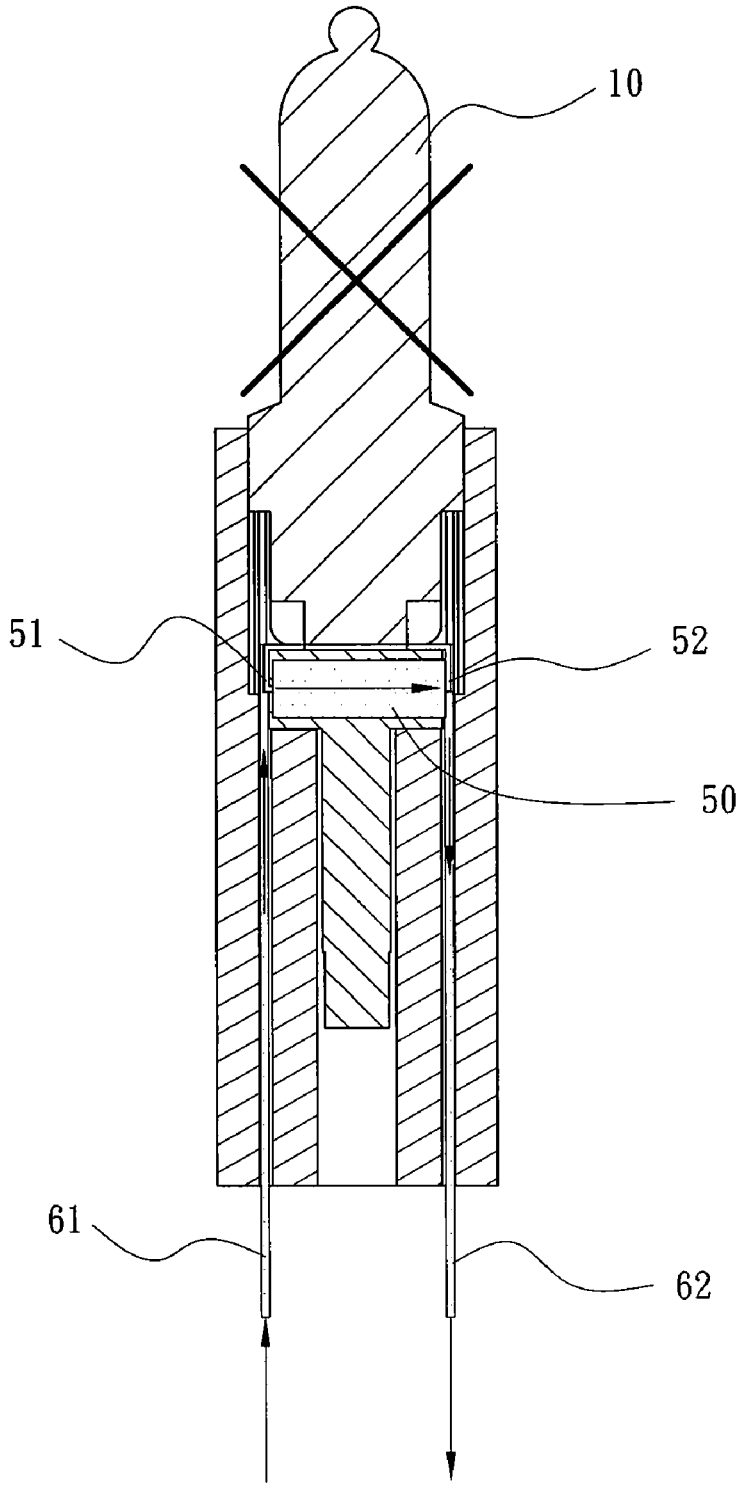
FIG. 5 is another cross-sectional view of the bulb socket of the present invention, illustrating a current flow through the current bypass device, instead of a broken bulb that is marked with a cross.
Figure 7:
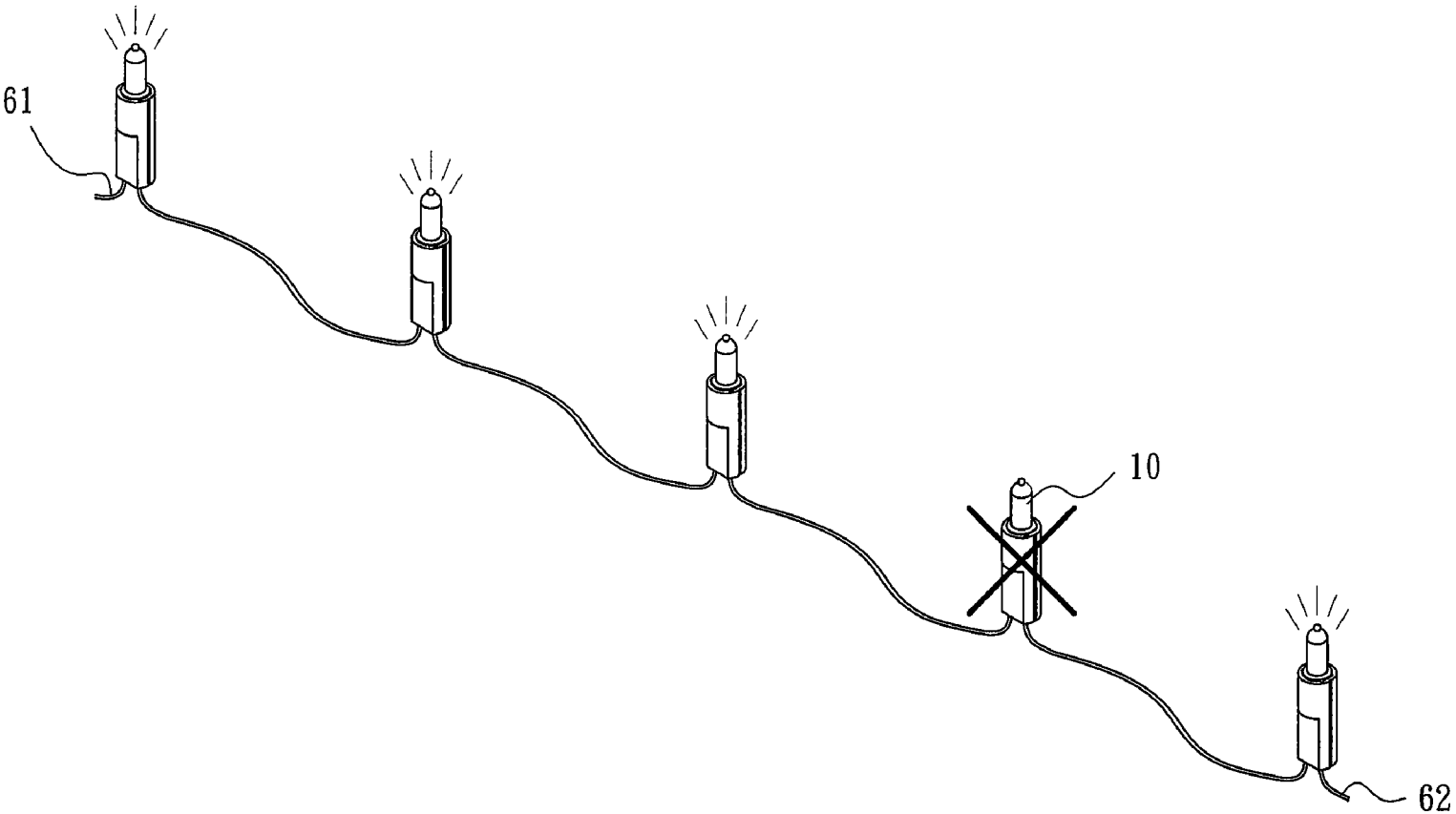
FIG. 7 is a perspective view illustrating a lamp string having one bulb broken and marked with a cross, which gives off no light, while other bulbs operate normally and give off light.

Referring to FIGS. 5 and 7, when the bulb 10 is broken or otherwise malfunctioning so as to show open-circuiting where current is not allowed to flow therethrough, the current supplied from the first wire 61 flows instead to the first conductor 51 of the current bypass device 50, through the current bypass device 50 and reaching the second conductor 52, and then flows into the second wire 62 for being further supplied to the next bulb of the lamp string. With the current bypass device 50, the electrical current is not interrupted at the broken bulb and the supply of the current to the next bulb is not affected.

The efficacy of the present invention is as follows:

(1) The present invention provides a novel structure of a current non-interruption bulb socket for a lamp string, wherein a plug that has a size and configuration for being removably receivable in the socket is set in the socket and the plug forms a bore that receives only the insertion of a current bypass device from a particular single end so as to ensure proper positioning of the current bypass device of which the installation direction might matter.

(2) The present invention provides a novel structure of a current non-interruption bulb socket that forms a modularized unit for constituting a lamp string, wherein a modular plug is received in the socket for current non-interruption protection and is also removable from the socket to allow the socket to receive a regular bulb for serving as a regular bulb/socket unit, which offers no current non-interruption protection. This simplifies the manufacturing of the lamp string and the plug can be separately made and receives the current bypass device therein beforehand. It no long needs to manufacture the whole socket together. The passing rate of the socket unit so made can be easily improved.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A bulb socket adapted to receive a bulb and connect to electrical wires to form a lamp string, the bulb socket comprising:

a husk, which is coupled to the wires and defines a cavity that receives and retains the bulb in such a way to establish electrical connections respectively between a first contact of the bulb and a first one of the wires and between a second contact of the bulb and a second one of the wires; and a plug, which is received in the cavity between the bulb and the husk, the plug forming a bore, which has an open end through which a current bypass device, is removably received into the bore in a given direction and a closed end, which is opposite to the open end in the given direction to prevent the current bypass device from being received into the bore in a reverse direction with respect to the given direction, the current bypass device having first and second conductors that are respectively in electrical connection with the first and second wires.

2. The bulb socket as claimed in claim 1, wherein the cavity of the husk and the plug are shaped to allow the plug to closely fit into the cavity.

3. The bulb socket as claimed in claim 1, wherein the bulb comprises a holder that is securely fit into an open end of the cavity of the husk so as to be retained in the cavity.

4. The bulb socket as claimed in claim 1, wherein the plug has a flat top face and wherein the first and second conductors of the current bypass device are shaped to position on the top face in a manner not contacting each other.

5. The bulb socket as claimed in claim 1, wherein the plug is removably received in the cavity of the husk.

6. The bulb socket as claimed in claim 1, wherein the plug comprises fool-proof means.

7. The bulk socket as claimed in claim 1, wherein the closed end of the bore forms an aperture through which the second conductor of the current bypass device extends out of the plug for electrical connection with the second wire, the first conductor of the current bypass device being exposed outside the plug through the open end of the bore to electrically connect the first wire.

8. The bulb socket as claimed in claim 7, wherein the plug has a flat top face, and wherein the first and second conductors of the current bypass device are shaped to position on the top face in a manner not contacting each other.

9. A lighting unit of a lamp string, comprising:

a light bulb, which comprises a bulb holder on which first and second electrical contacts are formed; and a bulb socket, which is electrically connected to first and second electrical wires of a lamp string, the bulb socket comprising:

a husk, which is coupled to the wires and defines a cavity that receives and retains the bulb holder in such a way to establish electrical connections respectively between the first contact of the bulb and the first wire and between the second contact of the bulb and the second one of the wires, and a plug, which is received in the cavity between the bulb and the husk, the plug forming a bore, which has an open end through which a current bypass device, is removably received into the bore in a given direction and a closed end, which is opposite to the open end in the given direction to prevent the current bypass device from being received into the bore in a reverse direction with respect to the given direction, the current bypass device having first and second conductors that are respectively in electrical connection with the first and second wires and thus the first and second contacts of the bulb.

10. The lighting unit as claimed in claim 9, wherein the plug has a flat top face and wherein the first and second conductors of the current bypass device are shaped to position on the top face in a manner not contacting each other.

11. The lighting unit as claimed in claim 9, wherein the plug is removably received in the cavity of the husk.

12. The lighting unit as claimed in claim 9, wherein the plug comprises fool-proof means.

13. The lighting unit as claimed in claim 9, wherein the closed end of the bore forms an aperture through which the second conductor of the current bypass device extends out of the plug for electrical connection with the second wire, the first conductor of the current bypass device being exposed outside the plug through the open end of the bore to electrically connect the first wire.

14. The lighting unit as claimed in claim 13, wherein the plug has a flat top face and wherein the first and second conductors of the current bypass device are shaped to position on the top face in a manner not contacting each other.

* * * * *